US006755102B2

(12) United States Patent
Buchanan et al.

(10) Patent No.: US 6,755,102 B2
(45) Date of Patent: Jun. 29, 2004

(54) METHOD AND APPARATUS FOR STEERING SAW BLADES

(75) Inventors: Greg Arnold Buchanan, High Prairie (CA); Kenneth Allan Ogg, High Prairie (CA)

(73) Assignee: Gordon Buchanan Enterprises Ltd., High Prairie (CA)

( * ) Notice: Subject to any disclaimer, the term of this patent is extended or adjusted under 35 U.S.C. 154(b) by 0 days.

(21) Appl. No.: 10/052,170

(22) Filed: Jan. 17, 2002

(65) Prior Publication Data

US 2002/0124698 A1 Sep. 12, 2002

(30) Foreign Application Priority Data

Jan. 18, 2001 (CA) ..... 2331534

(51) Int. Cl.[7] ..... B27B 7/04

(52) U.S. Cl. ..... 83/13; 83/425.3; 83/821; 144/39; 144/329

(58) Field of Search ..... 83/827, 829, 821, 83/508.3, 425.4, 169, 13, 425.3, 425.2, 368, 371, 828, 447, 523, 822–825; 144/357, 3.1, 39, 367, 369, 41, 329

(56) References Cited

U.S. PATENT DOCUMENTS

| | | | | | |
|---|---|---|---|---|---|
| 4,599,929 | A | * | 7/1986 | Dutina | 83/821 |
| 4,848,200 | A | * | 7/1989 | McGehee | 83/169 |
| 4,922,780 | A | * | 5/1990 | Hurdle, Jr. | 83/508.3 |
| 4,961,359 | A | * | 10/1990 | Dunham | 83/169 |
| 5,232,030 | A | * | 8/1993 | Knerr et al. | 144/248.6 |
| 5,722,474 | A | * | 3/1998 | Raybon et al. | 144/357 |
| 5,761,979 | A | | 6/1998 | McGehee | 83/425.4 |
| 5,809,859 | A | * | 9/1998 | Stroud et al. | 83/829 |
| 5,826,637 | A | * | 10/1998 | Newnes et al. | 144/382 |
| 5,870,936 | A | * | 2/1999 | McGehee | 83/13 |
| 5,921,162 | A | * | 7/1999 | Jackson et al. | 83/829 |
| 5,927,174 | A | * | 7/1999 | Newnes et al. | 83/827 |
| 5,946,995 | A | * | 9/1999 | Michell et al. | 83/425.3 |
| 6,062,281 | A | * | 5/2000 | Dockter et al. | 144/357 |
| 6,240,821 | B1 | * | 6/2001 | Landers et al. | 83/364 |
| 2001/0037715 | A1 | * | 11/2001 | McGehee et al. | 83/829 |

FOREIGN PATENT DOCUMENTS

| | | | |
|---|---|---|---|
| CA | 2198662 | 2/1977 | B27B/7/04 |

* cited by examiner

*Primary Examiner*—Allan N. Shoap
*Assistant Examiner*—Ghassem Alie
(74) *Attorney, Agent, or Firm*—Davis & Bujold, PLLC

(57) ABSTRACT

A method and apparatus for steering saw blades which includes an arbor rotatable about a rotation axis. Saw blades are mounted on the arbor in such a manner that the saw blades rotate with the arbor and are angularly adjustable in relation to the rotation axis of the arbor. A rigid guide assembly is provided having a plurality of guides each of which accommodate one the saw blades, such that movement of the guide assembly angularly adjusts the saw blades in unison. A leading edge of each of the saw blades is positioned along a common alignment plane. A support is provided for the guide assembly. The support has an underlying pivot axis spaced from and substantially perpendicular to the rotational axis of the arbor. This pivot axis is on the alignment plane such that the leading edge of each of the saw blades remain positioned along the alignment plane as the guide assembly is pivoted to move the guide assembly to alter the angular positioning of the saw blades. The method and apparatus avoids having to accommodate lateral offset when the saw blades are in an angular position.

3 Claims, 4 Drawing Sheets

METHOD AND APPARATUS FOR STEERING SAW BLADES

FIELD OF THE INVENTION

The present invention relates to a method for steering saw blades and a saw blade steering apparatus constructed in accordance with the teachings of the method; the method and apparatus having particular application in milling wood cants of irregular shape.

BACKGROUND OF THE INVENTION

U.S. Pat. No. 5,722,474 (Raybon et al) entitled "Method and apparatus for cutting a cant into boards" and U.S. Pat. Nos. 5,761,979 and 5,870,936 (McGehee) (Canadian equivalent 2,198,662) both entitled "Edge trimming and board ripping apparatus and method" relate to the processing of wood cants of irregular shape. The objective is to facilitate high speed sawing of wood cants of irregular shape into dimensionally similar portions of sawn lumber for the purpose of maximizing solid lumber recovery.

The preferred method described in McGehee involves the steps of: 1) scanning a wood cant to determine a cutting pattern; 2) directing the wood cant through a saw assembly consisting of saw blades mounted on and rotated by a rotating arbor; 3) adjusting in unison the skew angle of the saw blade axis of each of the saw blades relative to the arbor axis, with such adjustments being carried out while the saw blades are rotated by the arbor in order to cut the wood cant according to the cutting pattern determined by scanning step. As the skew angle of the saw blades is adjusted, the lateral position of the saw blades in relation to a centerline of the blade supports is altered. The operation is computer controlled with this lateral offset of the saw blades accommodated in the programming of the computer.

A limiting factor in applying the teachings of the McGehee method is in the saw blade steering apparatus used to adjust in unison the skew angle of the saw blades. Existing apparatus are expensive to manufacture and maintain, due to their complexity.

SUMMARY OF THE INVENTION

What is required is an alternative method and apparatus for steering saw blades.

According to one aspect of the present invention there is provided a method for steering saw blades. A first step involves providing an arbor rotatable about a rotation axis. A second step involves mounting saw blades on the arbor in such a manner that the saw blades rotate with the arbor and are angularly adjustable in relation to the rotation axis of the arbor. A third step involves providing a rigid guide assembly having a plurality of guides each of which accommodate one the saw blades, such that movement of the guide assembly moves the saw blades in unison. A leading edge of each of the saw blades is positioned along a common alignment plane. A fourth step involves providing a support for the guide assembly having an underlying pivot axis spaced from and substantially perpendicular to the rotational axis of the arbor. The pivot axis is on the alignment plane such that the leading edge of each of the saw blades remain positioned along the alignment plane as the guide assembly is pivoted to move the guide assembly to alter the angular positioning of the saw blades.

According to another aspect of the present invention there is provided an apparatus for steering saw blades which includes an arbor rotatable about a rotation axis. Saw blades are mounted on the arbor in such a manner that the saw blades rotate with the arbor and are angularly adjustable in relation to the rotation axis of the arbor. A rigid guide assembly is provided having a plurality of guides each of which accommodate one the saw blades, such that movement of the guide assembly angularly adjusts the saw blades in unison. A leading edge of each of the saw blades is positioned along a common alignment plane. A support is provided for the guide assembly. The support has an underlying pivot axis spaced from and substantially perpendicular to the rotational axis of the arbor. This pivot axis is on the alignment plane such that the leading edge of each of the saw blades remain positioned along the alignment plane as the guide assembly is pivoted to move the guide assembly to alter the angular positioning of the saw blades.

The method and apparatus for steering saw blades disclosed in the McGehee et al patent reference the leading edge of the saw blades are a substantial distance away from the pivot point of the guides. This creates a lateral offset of the saw blades when the guides are angularly pivoted which must be continually compensated for through computer programming to ensure correct positioning. With the above described method and apparatus, this issue is addressed by placing the pivot axis for the guide support directly below and in line with an alignment plane for the leading edge of the saw blades. The saw blades have negligible laterally movement relative to the alignment plane during left or right rotation of the guide support. This greatly reduces the amount of calculations required from the computer and simplifies the programming required to operate the system. Not having to account for lateral offset also increases the accuracy of the sawing.

The method and apparatus for steering saw blades disclosed in the McGehee et al patent reference utilizes a group of guides which are individually pinned so that each guide must slide against the adjacent guide in the group in order to pivot on it's own axis. Wear resulting from this sliding friction between the guides is addressed by providing for porting for pressure lubrication between the sliding guide surfaces and by hardening the guide surfaces. These measures serve to increase the cost of the guide system. With the above described method and apparatus, the guides are maintained as a rigid assembly and are pivoted as a group. This eliminates the need for a pressure lubrication system since the guides do not slide against one another. Guide construction is simplified and the guides can be made from conventional materials.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
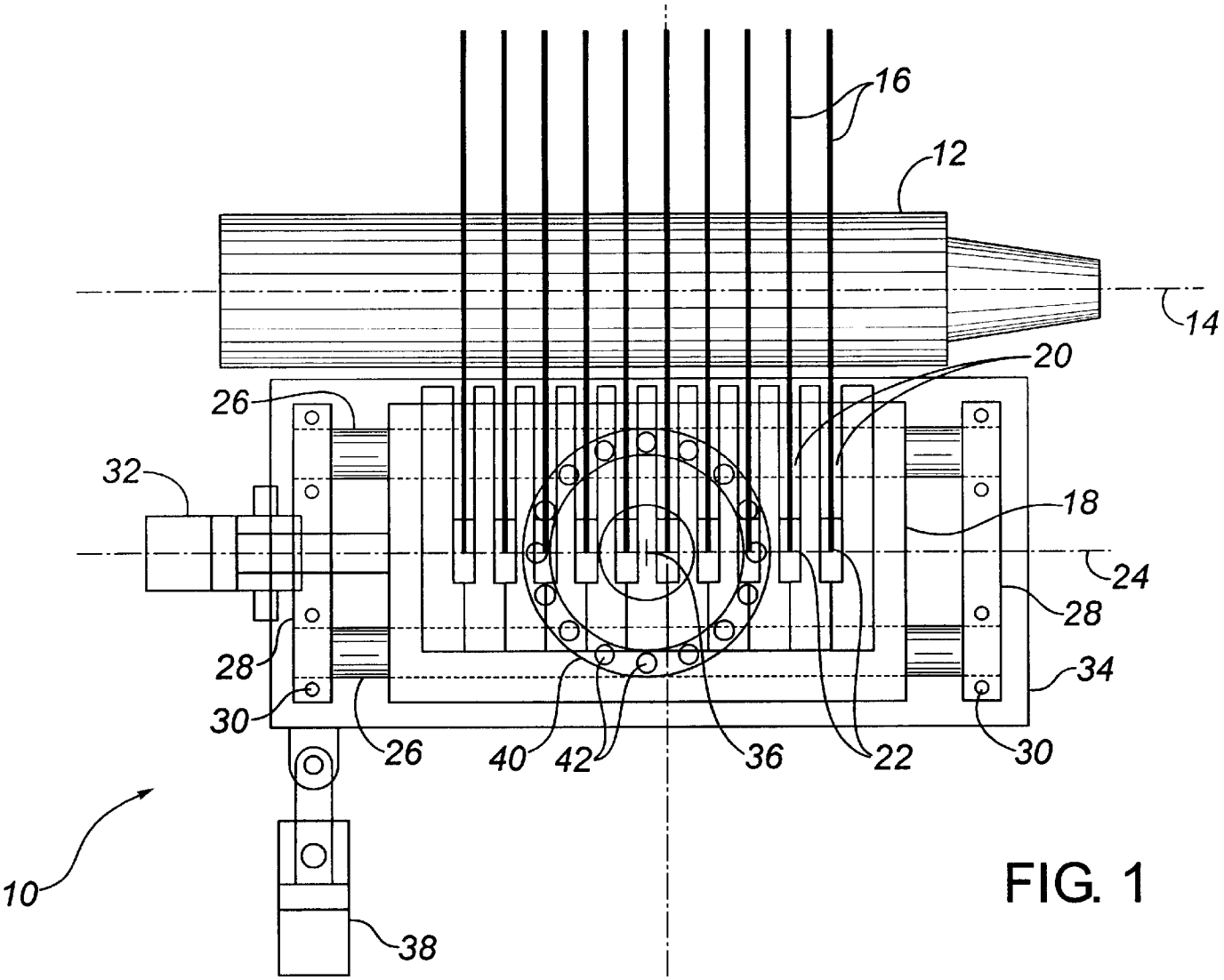
FIG. 1 is a top plan view of an apparatus for steering saw blades constructed in accordance with the teachings of the present invention.

The preferred embodiment, an apparatus for steering saw blades generally identified by reference numeral 10, will now be described with reference to FIGS. 1 through 4.

Figure 2:
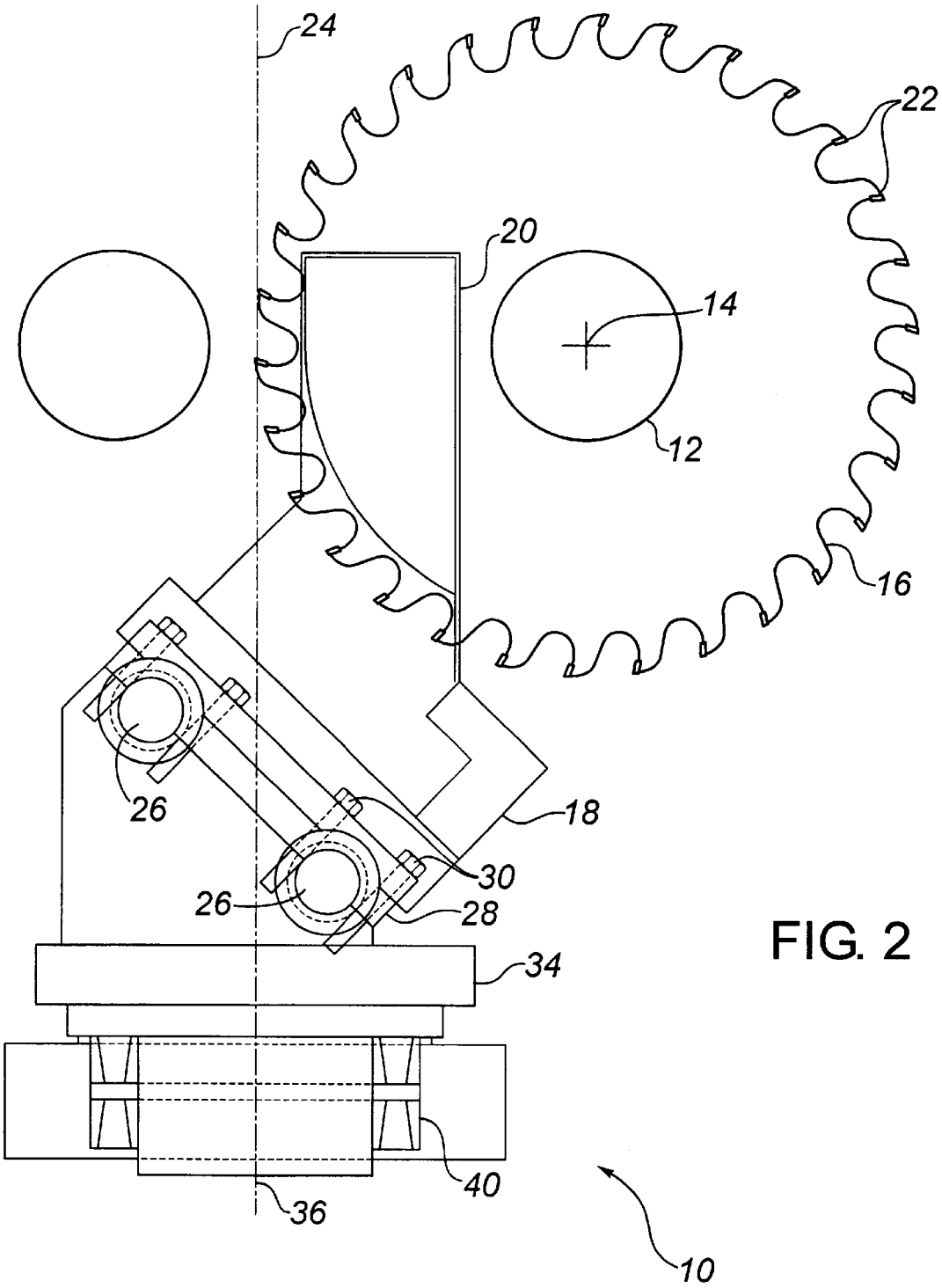
FIG. 2 is a side elevation view, in section, of the steering apparatus for saw blades illustrated in FIG. 1.
Figure 3:
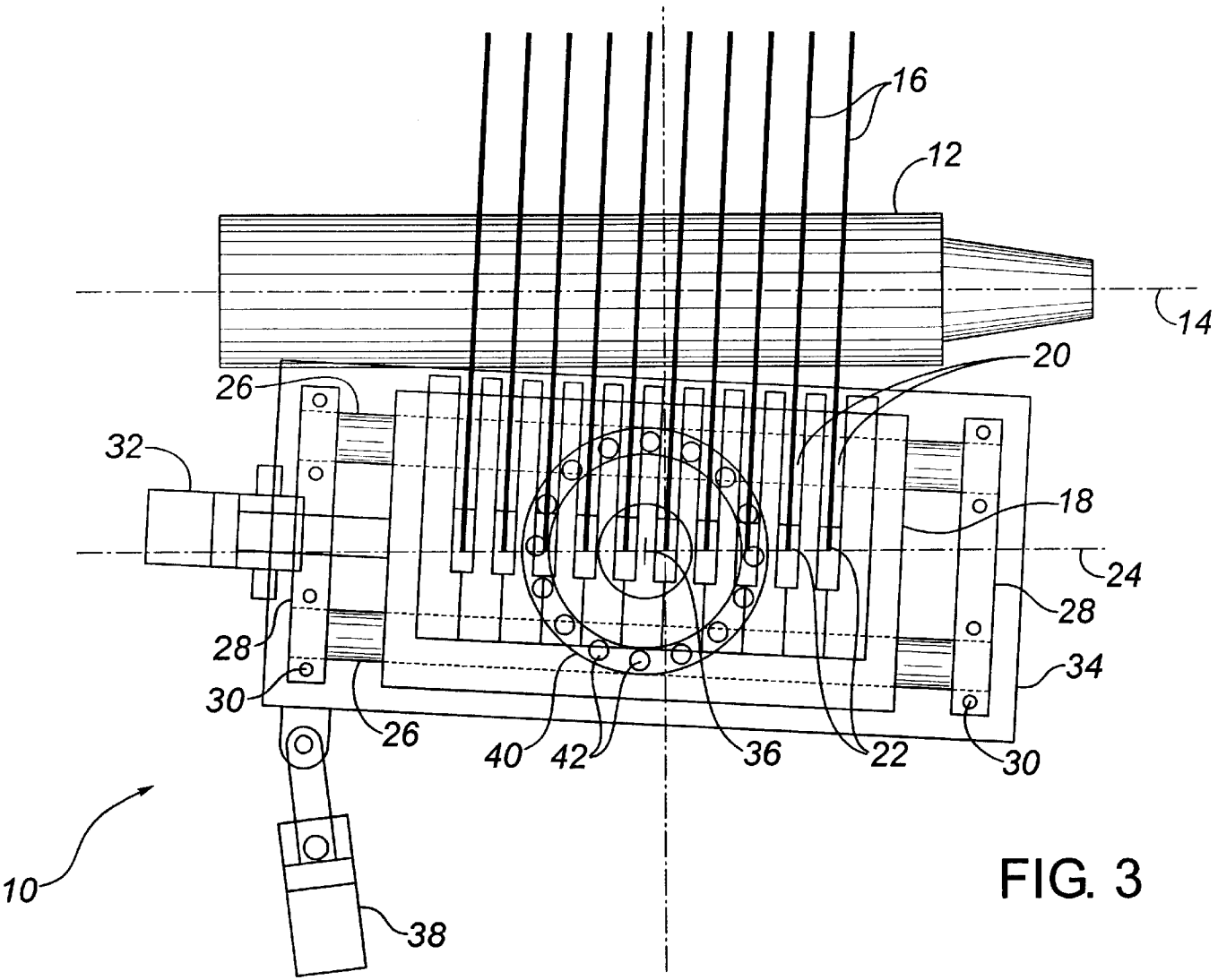
FIG. 3 is a top plan view of the steering apparatus for saw blades illustrated in FIG. 1, aligned right.
Figure 4:
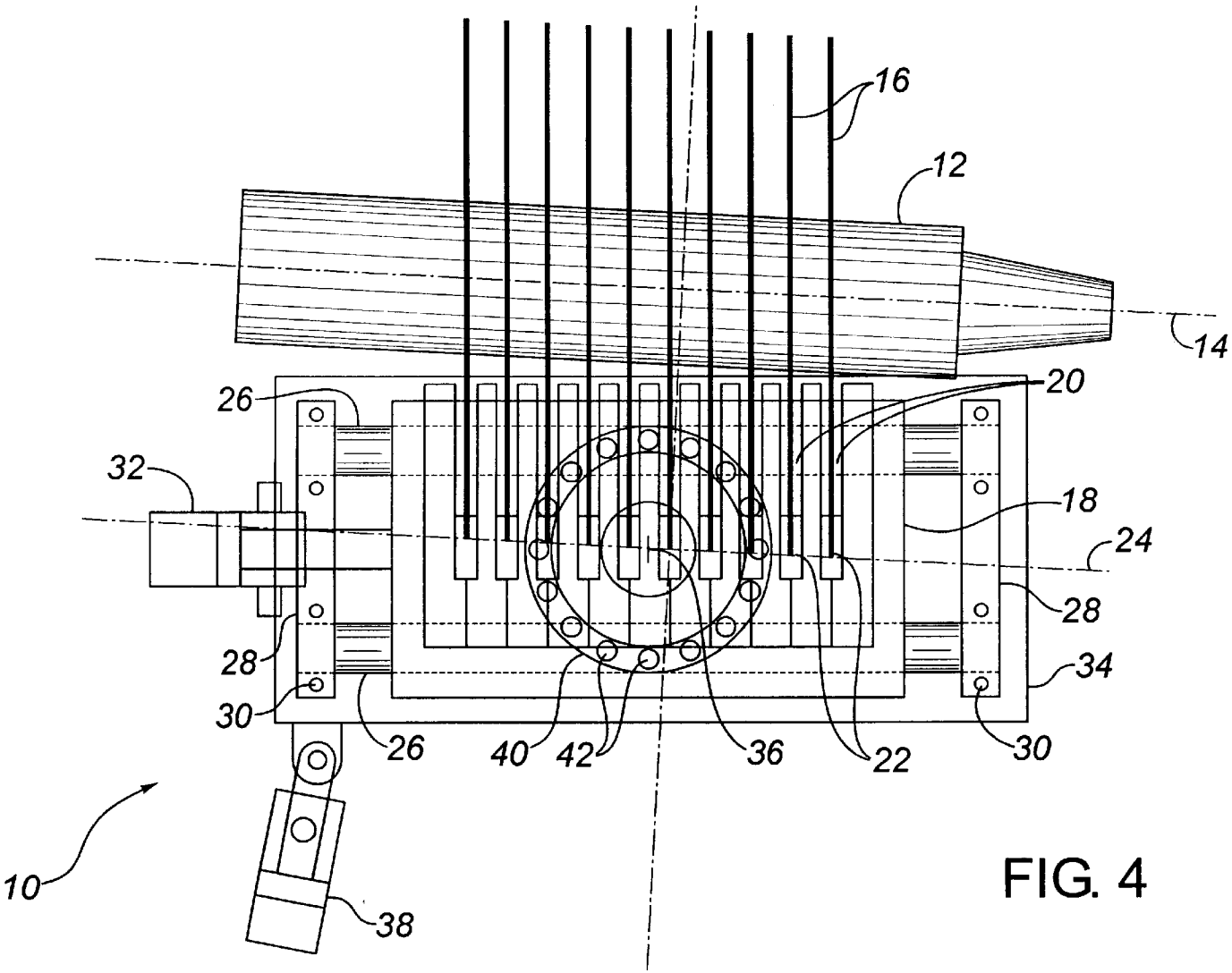
FIG. 4 is a top plan view of the steering apparatus for saw blades illustrated in FIG. 1, aligned left.

Structure and Relationship of Parts:

Referring to FIG. 1, there is provided an apparatus 10 for steering saw blades which includes an arbor 12 rotatable about a rotation axis 14. Referring to FIG. 2, saw blades 16 are mounted on arbor 12 in such a manner that saw blades 16 rotate with arbor 12 and are angularly adjustable in relation to rotation axis 14 of arbor 12 as illustrated in FIGS. 3 and 4. Referring to FIG. 1, a rigid guide assembly 18 is provided which has a plurality of guides 20, each of which accommodate one of saw blades 16, such that movement of guide assembly 18 angularly adjusts saw blades 16 in unison. A leading edge 22 of each saw blade 16 is positioned along a common alignment plane 24.

In the illustrated embodiment, guide assembly 18 includes two guide rails 26 onto which guides 20 are mounted. Clamps 28 with bolts 30 are provided at each end of guide assembly 18 for clamping guides 20 in place along guide rails 22. It will be appreciated, however, the configuration of guide assembly 18 could be varied as long as it is maintained as a rigid assembly.

A support table 34 is provided for guide assembly 18. A first drive mechanism 32 is provided for moving support table 34 parallel to rotational axis 14 of arbor 12. Support table 34 has an underlying pivot axis 36 that is spaced from and substantially perpendicular to rotational axis 14 of arbor 12. Pivot axis 36 is on alignment plane 24 such that leading edge 22 of each saw blade 16 remains positioned along alignment plane 24 as support table 34 is rotated to move guide assembly 18 to alter the angular positioning of saw blades 16. A second drive mechanism 38 is provided for directing movement of support table 34 around pivot axis 36. In the illustrated embodiment, support table 34 has an underlying bearing ring 40 that uses pivot axis 36 as its centroid and has roller bearings 42 that permit rotational movement of support table 34. Upon movement of second drive mechanism 38, support 34 is able to rotate on bearing ring 40 around pivot axis 36. It will be appreciated, however, that the configuration of support table 34, first drive mechanism 32 and second drive mechanism 38 could be varied as long as the relative position of pivot axis 36 and alignment plane 24 remained the same.

Operation

The use and operation of apparatus for steering saw blades 10 will now be described with reference to FIGS. 1 though 4. Referring to FIG. 1, during sawing operations arbor 12 rotates at high speed about rotational axis 14. Saw blades 16 are rotatably fixed to and rotate with arbor 12. As an irregular shaped cant passes through saw blades 16 first drive mechanism 32 and second drive mechanism 38 react dynamically in conjunction with one another and in synchronization to the forward advancement of the cant to provide dimensionally similar portions of sawn lumber, as illustrated in FIGS. 3 and 4. First drive mechanism 32 moves support table 34 back and forth parallel to rotational axis 14 of arbor 12. Second drive mechanism 38 effects limited rotational movement of support table 34 around pivot axis 36. Rigid guide assembly 18 moves with support table 34 and guides 20 angularly adjust saw blades 16 in response to such movement. It must be noted that leading edge 22 of each of saw blades 16 which is positioned along common alignment plane 24 in a straight orientation illustrated in FIG. 1, remain aligned along common alignment plane 24 in the angular positions illustrated in FIGS. 3 and 4. This consistent relationship was not possible in prior art apparatus, which unavoidably experienced some degree of lateral offset that had to be accommodated in computer program. This consistent relationship is made possible by the relative positioning of common alignment plane 24 and pivot axis 36 with pivot axis 36 being on alignment plane 24. It must also be noted that since guide assembly 18 is rigid, guides 20 are pivoted as group which also assists to maintaining leading edge 22 of each saw blade 16 along alignment plane 24 without regard to the angular position. Saw blades 16 have negligible lateral movement relative to alignment plane 24 during left or right rotation of support 34 which eliminates the need to make special provision to accommodate lateral offset of saw blades 16 during operation. Furthermore, the need for a pressure lubrication system is also eliminated as guides 20 do not slide against one another. It will be understood from reviewing the above description how these features simplify both the construction and operation of apparatus 10.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. A method for steering saw blades, comprising the steps of:

providing an arbor rotatable about a rotation axis;

mounting saw blades on the arbor in such a manner that the saw blades rotate with the arbor and are angularly adjustable in relation to the rotation axis of the arbor;

providing a rigid guide assembly having a plurality of guides each of which accommodates one of the saw blades, such that movement of the guide assembly moves in unison the saw blades, a leading edge of each of the saw blades being positioned along a common alignment plane;

providing a support for the guide assembly, the support having a single vertical pivot axis spaced from and substantially perpendicular to a horizontal plane on which the rotational axis of the arbor lies, the pivot axis being intersecting with the alignment plane such that the leading edge of each of the saw blades remain positioned along the alignment plane as the guide support is rotated about the pivot axis to move the guide assembly to alter the angular positioning of the saw blades.

2. An apparatus for steering saw blades, comprising:

an arbor rotatable about a rotation axis;

saw blades mounted on the arbor in such a manner that the saw blades rotate with the arbor and are angularly adjustable in relation to the rotation axis of the arbor;

a rigid guide assembly having a plurality of guides each of which accommodates one of the saw blades, such that movement of the guide assembly angularly adjusts the saw blades in unison, a leading edge of each of the saw blades being positioned along a common alignment plane;

a support for the guide assembly, the support having a single vertical pivot axis spaced from and substantially to a horizontal plane on which the rotational axis of the arbor lies, the pivot axis being intersecting with the alignment plane such that the leading edge of each of the saw blades remain positioned along the alignment plane as the guide support is rotated about the pivot axis to move the guide assembly to alter the angular positioning of the saw blade.

3. An apparatus for steering saw blades, the apparatus comprising:

an arbor rotatable about a rotation axis;

a plurality of saw blades mounted on the arbor so as to rotate with the arbor, and the plurality of saw blades being angularly adjustable in relation to the rotation axis of the arbor;

a rigid guide assembly having a plurality of guides each of which accommodates one of the plurality of saw blades;

a support for the guide assembly, the support having a single pivot axis which is spaced from and extends substantially normal to the rotational axis of the arbor, the leading edge of the saw blades intersecting the pivot axis, and the rigid guide assembly being pivotably about the vertical pivot whereby pivoting movement of the rigid guide assembly, about the vertical pivot, adjusts the angular position of the plurality of saw blades in unison with one another.

* * * * *